US007481471B2

(12) United States Patent
Andersen et al.

(10) Patent No.: US 7,481,471 B2
(45) Date of Patent: Jan. 27, 2009

(54) CHILD SAFETY BARRIER WITH A LOCKING DEVICE

(75) Inventors: Jesper Andersen, Låsby (DK); Robert James Hicks, Hemsby (GB)

(73) Assignee: Baby Dan A/S, Lasby (DK)

( * ) Notice: Subject to any disclaimer, the term of this patent is extended or adjusted under 35 U.S.C. 154(b) by 0 days.

(21) Appl. No.: 10/571,258

(22) PCT Filed: Sep. 10, 2004

(86) PCT No.: PCT/DK2004/000601

§ 371 (c)(1),
(2), (4) Date: Aug. 4, 2006

(87) PCT Pub. No.: WO2005/024167

PCT Pub. Date: Mar. 17, 2005

(65) Prior Publication Data

US 2007/0022666 A1 Feb. 1, 2007

(30) Foreign Application Priority Data

Sep. 11, 2003 (GB) ..... 0321363.4
Jul. 6, 2004 (DK) ..... BA 2004 00196 U

(51) Int. Cl.

| | |
|---|---|
| ***E05C 17/56*** | (2006.01) |
| ***E05C 21/02*** | (2006.01) |
| ***E05C 17/00*** | (2006.01) |
| ***B60R 25/04*** | (2006.01) |
| ***E06B 7/00*** | (2006.01) |

(52) U.S. Cl. ..... 292/251.5; 70/257; 49/465; 49/394; 49/57

(58) Field of Classification Search ..... 292/251.5; 49/50–57, 394

See application file for complete search history.

(56) References Cited

U.S. PATENT DOCUMENTS 5,217,265 A * 6/1993 Lerner et al. ..... 292/200
5,396,732 A 3/1995 Andersen (Continued)

FOREIGN PATENT DOCUMENTS

DE 20016845 1/2001

(Continued)

*Primary Examiner*—Patricia L Engle
*Assistant Examiner*—Kristina R Fulton
(74) *Attorney, Agent, or Firm*—Dykema Gossett PLLC

(57) ABSTRACT

A child safety barrier with a door secured in a U-shaped frame has a locking device which cannot be operated by children. The locking device has an activation unit which, when receiving a signal from a signal generator, releases the locking device so that the door may be opened or closed, which, in one embodiment, must take place within 2-4 seconds of the point of time when the signal generator is activated. The activation device may be formed by a mechanical activation mechanism, while the signal generator may be a push-button, an electric voltage or a remote control using a connection of the type IR, Bluetooth or the like. In a preferred embodiment, the activation device is connected with a push/pull rod whose one end is connected with a relay, while its other end is connected with a movable post extending inside a column in the U-shaped frame to which the door is secured. The invention provides a child safety barrier having a locking device where the locking device of the child safety barrier may be opened without using hands, feet and/or legs.

13 Claims, 4 Drawing Sheets

U.S. PATENT DOCUMENTS

| | | | | |
|---|---|---|---|---|
| 6,190,082 | B1 * | 2/2001 | Butterfield | 403/325 |
| 6,499,254 | B2 * | 12/2002 | Rossman et al. | 49/55 |
| 6,711,857 | B1 * | 3/2004 | Wagnitz et al. | 49/394 |
| 7,100,405 | B2 * | 9/2006 | West | 70/100 |
| 2002/0196123 | A1 | 12/2002 | Diehl et al. | |

FOREIGN PATENT DOCUMENTS

| | | |
|---|---|---|
| GB | 1089798 | 11/1967 |
| GB | 2088939 | 6/1982 |
| GB | 2197376 | 5/1988 |
| WO | 9740253 | 10/1997 |

* cited by examiner

CHILD SAFETY BARRIER WITH A LOCKING DEVICE

BACKGROUND OF THE INVENTION

The invention relates to a child safety barrier with a door which has a locking device. Such child safety barriers, which are used for blocking openings to stairs, windows, doors and the like, are available in many versions. Most of them are composed of tubular steel, wood or plastics and have means allowing them to be mounted in openings of different widths by means of a special bracket.

It is common to these child safety barriers that they are provided with a locking device which cannot be operated by children, who are thus prevented from opening the door, with the resulting fatal consequences this may have.

Typical basic structures of these child safety barriers may be as follows:

a) There are purely spring-loaded doors where a vertical, upwardly directed lift can lift the door out of its bracket.

b) "Push and lift" devices where two simultaneous movements are to be performed to release the locking device of the door.

c) Activation of a foot pedal down against a floor to make it possible to push the door by a knee.

The above-mentioned types of doors are frequently provided with a U-shaped lattice frame to which a door is hinged between two columns in the U-shaped frame, said door being provided with locking means to ensure that small children cannot open the door.

As for examples of child safety barriers with locking devices which cannot be operated by children, reference may be made to WO 97/40253 and U.S. Pat. No. 5,396,732.

The above-mentioned locking devices are activated in that hands and/or feet/legs are to activate the locking device when a passageway is to be established. If, e.g., a parent has a child on his/hers arm, only one arm will be free, which may make it difficult and in some cases impossible to activate the locking device.

If, additionally, the parent leans against the door with the child on his/hers arm in order to activate the locking device, dangerous situations may arise, if the door is placed in front of stairs, as the pressure on the door may mean that both the child and the parent risk falling down the stairs when the door is opened.

GB Patent No. 1,089,798 discloses a safety door which, by means of magnets, is protected against the possibility that a child can push the door upwards, and, thus, it cannot be opened by the child. According to the GB document, it is not so that the magnets are involved in the actual locking of the door, but are involved in protecting the locking device against being opened and in ensuring that the door does not bounce back if it is slammed.

Accordingly, an object of the invention is to provide a release of a locking device for a child safety barrier, where it is not necessary to use hands and/or feet/legs.

SUMMARY OF THE INVENTION

The object of the invention is achieved by a child safety barrier that includes a locking device that incorporates an activation unit which, when receiving a signal from a signal generator, releases the locking device so that the door may be opened or closed.

When the door is fixed in a U-shaped frame between two columns, where one column accommodates a slidable column on which a locking housing is mounted through a groove in the one column, while a horizontal, movable locking pawl is mounted in an outer post of the door, said locking pawl being movable into a groove in the locking housing, and a magnet is arranged at the bottom of the locking housing, and an inclined slide face is arranged inside the locking housing, then two actions are to be provided in order to open the door, viz. release of the locking pawl from the magnet force and subsequent retraction of the locking pawl, which may be performed in the same operation, as the displacement of the slidable column releases the locking pawl from the magnet, while the inclined side face in the locking housing forces the locking pawl back.

This operation cannot be performed by children, since they do have not access to the signal generator which is to initiate the operation.

Expediently, the activation device is connected with one end of a push/pull rod, while the opposite end of the push/pull rod is connected with the slidable column, and the push/pull rod, over part of its length, is moved through holes in a housing having upper and lower surfaces, said holes being arranged in the upper and lower surfaces, and a spring is mounted inside the housing whose one end abuts one of the surfaces, while the opposite end of the spring is secured to the push/pull rod so that the push/pull rod is affected by the force provided by the spring, thereby providing a stable mechanical structure of the locking device with stable states in the open as well as the closed state of the door.

An easy way of operating the locking device is that the activation device is formed by a relay.

To additionally ensure that a child cannot operate the locking device, it is advantageous if the activation device is formed by a mechanical activation mechanism disposed behind a cover or the like which cannot be opened by children.

In addition, it is advantageous if the signal generator is formed by a push-button, or the push-button is disposed close to the door, but inaccessible to children, or the signal generator is formed by an electric voltage, or the signal generator is formed by a transmitter which causes a receiver to release the locking device so that the door may be opened, or that the signal generator is provided wirelessly from a remote control using a connection of the type IR, BLUETOOTH® or the like.

When the door can be opened only after a certain time delay, e.g., of 2-4 seconds, after the activation device has received a signal from the signal generator, it is ensured that an adult can reach the door before it physically can be opened.

In order to ensure that the door is locked if an unintentional signal is applied to the signal generator, it is an advantage if the door, after actuation of the activation device, can be opened only within 2-4 seconds, during which period of time it is not likely that a child tries to push the door up.

It is also advantageous if the door may be caused to assume a position where it is closed only after a user has physically affected the door, thereby avoiding the situation that a door seemingly closed is ajar in reality.

Finally, it is advantageous if the door can be closed only after a parent has physically affected the door, as the parent then always knows that a physical action is to be performed when the door is to be closed.

The invention will now be explained more fully with reference to the drawings.

BRIEF DESCRIPTION OF THE DRAWINGS

FIG. 1 shows a child safety barrier which consists of a U-shaped outer frame 1 and a door 4, shown here as a lattice, hinged to the frame.

Figure 1:
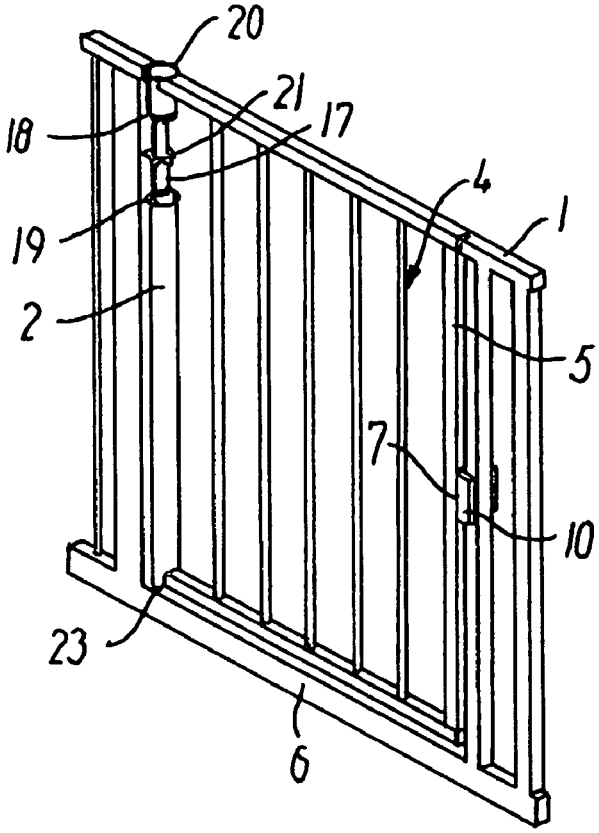
FIG. 1 shows a child safety barrier in perspective with a door according to the invention.

A locking housing 10 is fixed to a vertical post 13 of the U-shaped frame 1 while a locking pawl 8 is mounted adjoining the locking housing 10 and is secured to a vertical post 5 of the door 4.

Figure 2:
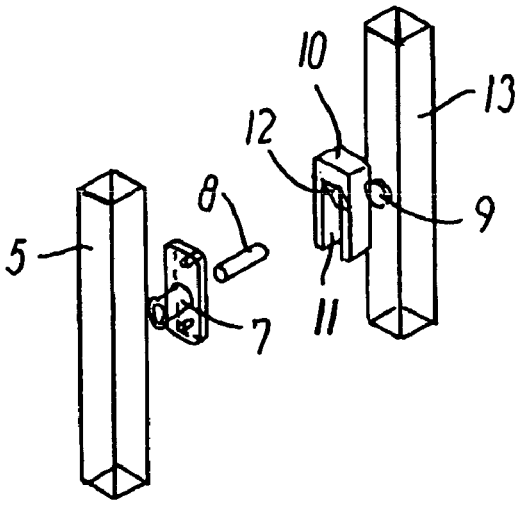
FIG. 2 shows an exploded section of a magnetic locking device according to the invention.
Figure 3:
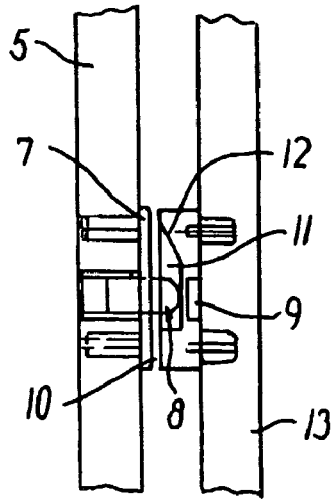
FIG. 3 shows the locking device of FIG. 2, seen from the front.

FIGS. 2 and 3 are more detailed views of the parts which are incorporated in the magnetic locking device.

Normally, the door will swing to its closed position when a spring (not shown) or a cam disc affects the door to its closed position.

When the door is swung to the closed position, the locking pawl 8 will be pulled toward a magnet 9 disposed inside at the bottom of the locking housing 10, the locking pawl entering into a groove (or channel) 11 in the locking housing 10, whereby the door 4 will be locked to the U-shaped frame 1.

As will be seen, the locking housing 10 is formed with an inclined face 12 on which the locking pawl 8 may slide, cf. the following.

Figure 4:
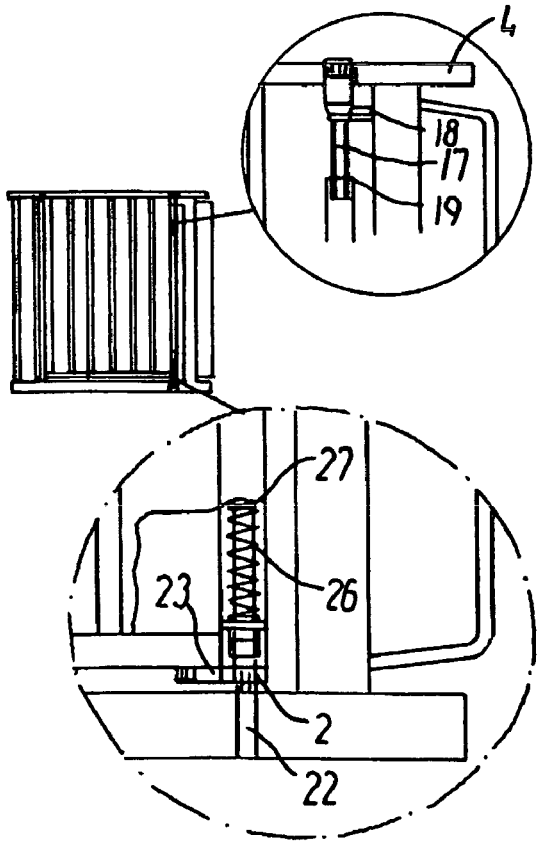
FIG. 4 shows a section of hinge parts of the child safety barrier, seen from the front.

FIG. 4 shows the upper and lower hinge parts of the door which are formed by an upper hinge pin 17 which is secured to the door 4 with two plastics sleeves 18, 19. The pin 17 may rotate freely relative to a hinge pin bushing 21. Further, the hinge pin 17 and the entire door 4 may be displaced in a vertical direction.

The lower hinge parts of the door may be formed by a hinge pin bushing 23, which is connected with the door 4 and may rotate relative to a hinge pin 22 securely fixed to a lower transverse rail 6 of the U-shaped frame. The door may thus be lifted vertically, as the hinge pin 17 may be moved between the plastics sleeves 18, 19, while the hinge pin bushing may be moved relative to the hinge pin 22.

A spring 26 is mounted on the lower hinge pin 22 and is secured and fixed against a support ring 27 which is secured in a vertical post 2 of the door 4.

The child safety barrier may be opened by lifting the door 4 with a sufficient force so that the spring 26 is compressed. At the same time the locking pawl 8 is moved upwards in the groove or the slot 11, whereby the locking pawl is removed from the magnet 9 and slides on the inclined face 12, thereby cancelling the magnetic force between the locking pawl 8 and the magnet 9, following which the door may be opened.

Figure 5:
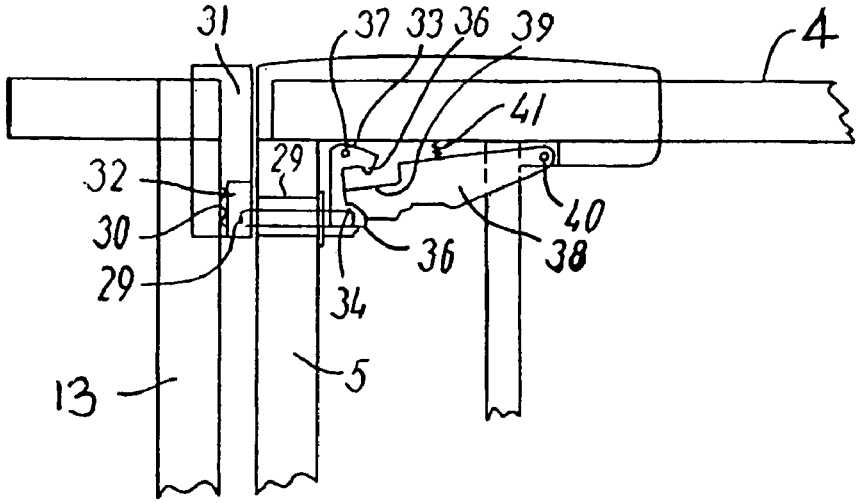
FIG. 5 shows another embodiment of a magnetic locking device.
Figure 6:
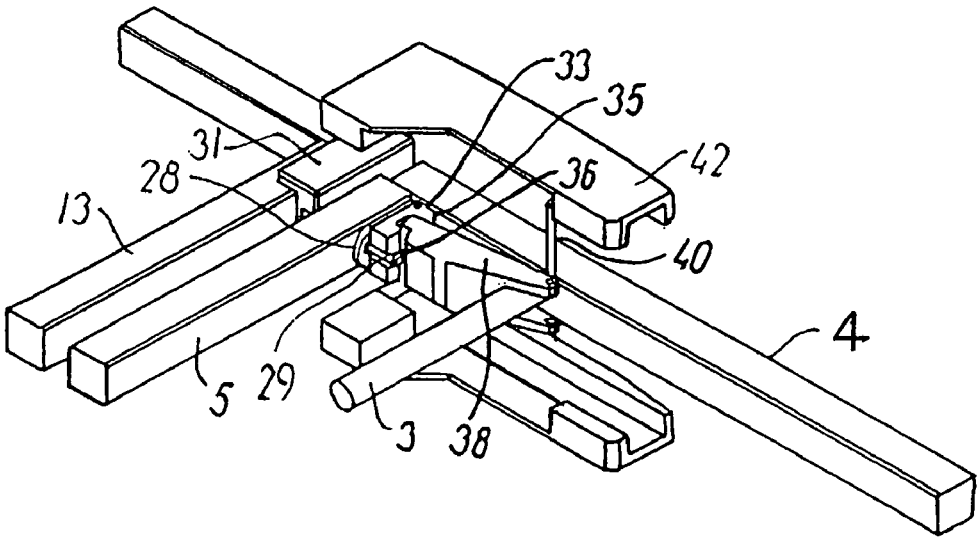
FIG. 6 shows the magnetic locking device of FIG. 5, obliquely from below in perspective.

In FIGS. 5 and 6, the numeral 42 designates a two-part handle which surrounds a moulded trigger 38, a lock 33, a locking pawl 29 and a locking bushing 28. These parts are secured to the top of the door 4. As will be seen, the lock can rotate about its pivot point 37.

A magnet housing 31 is secured to the vertical post 2. The magnet housing 31 has an oblong, vertical locking groove 32.

When the door 4 approaches the fully closed position, the locking pawl 29 is attracted by a magnetic force from a magnet 30 disposed at the bottom of the locking groove 32 so that the locking pawl is moved horizontally into the locking groove 32.

The locking pawl is connected at its one end with a lock 33 having an inclined engagement face or wall 36 on which a face on one end of the trigger 38 may rest. At its other end, the trigger is rotatably connected with the handle 42 about a pivot point 40. Further, the trigger is biased with a spring 41 so that the end of the trigger 38 opposite the pivot point is pressed against the inclined face 36 on the lock 33.

In the position shown in FIGS. 5 and 6, the door 4 is locked to the U-shaped frame 2.

To unlock the door, an upwardly directed force is applied from the handle to the trigger 38, whereby the trigger rotates about its pivot point 40, while the lock 33 rotates about a pivot point 37, which means that the locking pin is displaced from the magnet 30 in the locking groove 32. If the force on the lock 33 is maintained, the door may be opened.

Figure 7:
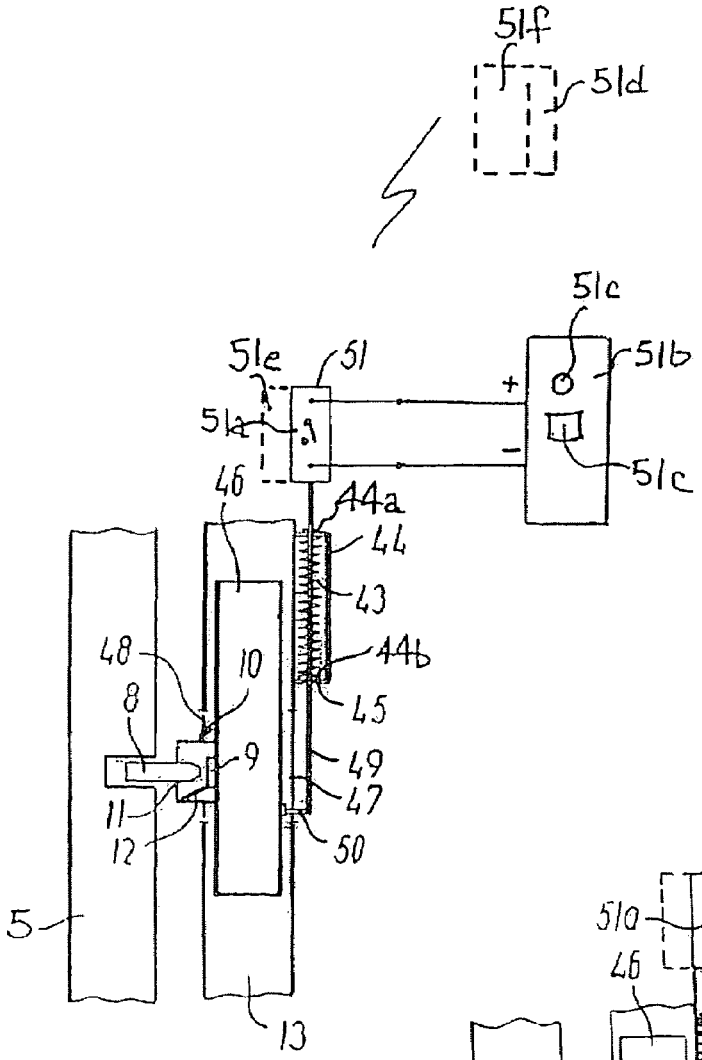
FIG. 7 shows a basic sketch of a further embodiment of the magnetic locking device according to the invention.

FIG. 7 also shows the vertical post 5 of the door 4 with the locking pawl 8 which is capable of engaging the groove 11 in the locking housing 10, which contains the magnet 9 and the inclined face 12, which, however, is shown here at the bottom of the locking housing 10, which is mounted on a column 46, movable relative to the column 13 of the U-shaped frame, through a groove 48 in the column 13.

Laterally of the column 13 and through a groove 47 in it, there is mounted a push/pull rod 49 at an attachment point 50 on the movable column 46. The push/pull rod is spring-biased in a housing 44 by a spring 43 which causes the column to assume the position shown in the figure.

The spring is secured to the push/pull rod at its one end, for example, but not necessarily, with a small plate shown at 45 capable of engaging the bottom of the housing 44, while the opposite end of the spring engages the upper part of the housing 44.

The free end of the push/pull rod is connected with an actuator 51, e.g. a coil actuator, in a housing which is immovably secured to e.g. the column 13 of the U-shaped frame.

Figure 8:
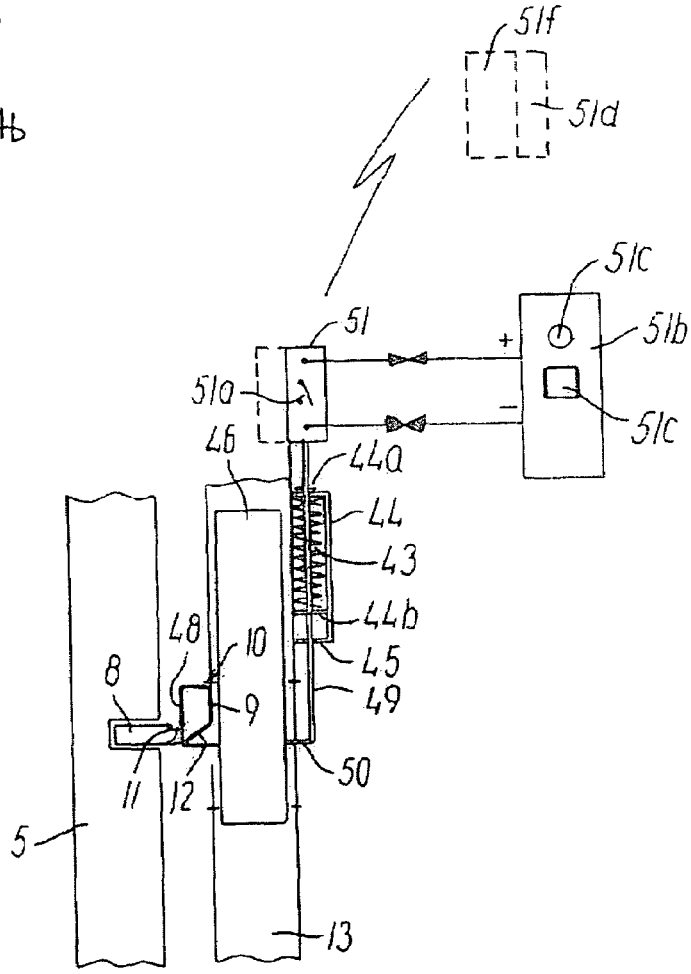
FIG. 8 illustrates the push/pull rod in FIG. 7 can move the pawl therein.

Under the action of a voltage from a battery (not shown) across the terminals shown, the push/pull rod 49 and thereby the column 46 are pulled upwards relative to the column 13 (see FIG. 8), which means in turn that the locking pawl is released from the magnet 9 and slides on the inclined face 12, following which the door may be opened.

Item 51A denotes a relay that can be operated wirelessly from a remote control 51D that is able to activate a transmitter 51F that transmits a signal to receiver 51E, which activates the relay. This is in principle the same way a remote control device operates a TV set. In an alternative way, it is possible to operate the relay 51A through a wall-mounted signal generator 51B which, when a pushbutton 51C is pressed, applies an electric voltage to wires that are connected to the activation unit 51.

When the door is to be closed again, the voltage is removed from the terminals, which causes the spring 43 to move the push/pull rod and thereby the door downwards so that the door may be locked.

The invention claimed is:

1. The child safety barrier which comprises:

a U-shaped frame which defines an opening between first and second vertical columns, and a door which is pivotally connected to said U-shaped frame to open and close said opening, said door including a vertical post that, when the door closes said opening, is positioned adjacent said second vertical column, and mounts a locking pawl which is movable towards and away from the second vertical column, said second vertical column defining a groove and containing a third column which is slidable therein, said third column mounting a lock housing which extends through said groove towards said opening and which includes a channel having an inclined wall and a magnet at a bottom thereof, the locking pawl being positionable within the channel by attraction of said magnet to lock the door in a closed position relative to the U-shaped frame, a push-pull rod connected to said third column, and an activation device connected to said push-pull rod to move said third column within said second column and said lock housing along said groove to move said locking pawl along said inclined wall and away from said magnet to unlock the door relative to the U-shaped frame after receiving a signal from a signal generator.

2. The child safety barrier according to claim 1, wherein the push/pull rod, over part of its length, is moved through holes in a housing having upper and lower surfaces, said holes being arranged in the upper and lower surfaces, and wherein a spring is mounted inside the housing whose one end abuts one of the surfaces, while an opposite end of the spring is secured to the push/pull rod so that the push/pull rod is affected by the force provided by the spring.

3. The child safety barrier according to claim 1, wherein the activation device comprises a relay.

4. The child safety barrier according to claim 1, wherein the activation device comprises a mechanical activation mechanism disposed behind a cover which cannot be opened by children.

5. The child safety barrier according to claim 1, wherein the signal generator comprises a push-button.

6. The child safety barrier according to claim 5, wherein the push-button is disposed close to the door, but inaccessible to children.

7. The child safety barrier according to claim 1, wherein the signal generator comprises an electric voltage.

8. The child safety barrier according to claim 1, wherein the signal generator comprises a transmitter which causes a receiver to release the locking pawl so that the door may be opened.

9. The child safety barrier according to claim 1, wherein the signal generator is provided wirelessly from a remote control.

10. The child safety barrier according to claim 1, wherein the door can be opened only after a time delay of 2-4 seconds after the activation device has received a signal from the signal generator.

11. The child safety barrier according to claim 1, wherein after activation of the activation device, the door can be opened only within 2-4 seconds.

12. The child safety barrier according to claim 1, wherein the door can be caused to assume a position in which it is closed only after a user has physically affected the door.

13. The child safety barrier according to claim 1, wherein the door can be closed only after a user has physically affected the door.

* * * * *